US007738824B2

(12) United States Patent
Wu

(10) Patent No.: US 7,738,824 B2
(45) Date of Patent: Jun. 15, 2010

(54) TREATED CARBON BLACK INTERMEDIATE TRANSFER COMPONENTS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/181,409

(22) Filed: Jul. 29, 2008

(65) Prior Publication Data

US 2010/0028059 A1 Feb. 4, 2010

(51) Int. Cl.
*G03G 15/01* (2006.01)

(52) U.S. Cl. ..... 399/302; 399/308; 430/125.33

(58) Field of Classification Search ..... 399/162, 399/302, 303, 308, 312, 313, 329; 430/125.32, 430/125.33
See application file for complete search history.

(56) References Cited

U.S. PATENT DOCUMENTS

| | | | | |
|---|---|---|---|---|
| 6,291,572 | B1 * | 9/2001 | Brown et al. | 524/492 |
| 6,397,034 | B1 | 5/2002 | Tarnawskyj et al. | |
| 6,602,156 | B2 | 8/2003 | Schlueter, Jr. | |
| 7,031,647 | B2 | 4/2006 | Mishra et al. | |
| 7,130,569 | B2 | 10/2006 | Goodman et al. | |
| 7,139,519 | B2 | 11/2006 | Darcy, III et al. | |
| 7,280,791 | B2 | 10/2007 | Goodman et al. | |
| 2001/0016531 | A1 * | 8/2001 | Morikoshi et al. | 474/237 |
| 2003/0069332 | A1 * | 4/2003 | Agostini et al. | 523/205 |
| 2004/0266915 | A1 * | 12/2004 | Kirino | 523/212 |
| 2006/0029428 | A1 * | 2/2006 | Taniguchi et al. | 399/176 |
| 2006/0269772 | A1 * | 11/2006 | Han et al. | 428/560 |
| 2008/0255304 | A1 * | 10/2008 | Nakashima et al. | 525/100 |
| 2009/0064900 | A1 * | 3/2009 | Nakata et al. | 106/472 |

OTHER PUBLICATIONS

Jin Wu, U.S. Application No. (not yet assigned) on Treated Carbon Black Intermediate Transfer Components, filed concurrently herewith.

Jin Wu, U.S. Appl. No. 12/129,995 on Polyimide Intermediate Transfer Components, filed May 30, 2008.

* cited by examiner

*Primary Examiner*—Robert Beatty
(74) *Attorney, Agent, or Firm*—E. O. Palazzo

(57) ABSTRACT

An intermediate transfer media such as a belt that includes a poly(vinylalkoxysilane) surface treated carbon black.

26 Claims, No Drawings

TREATED CARBON BLACK INTERMEDIATE TRANSFER COMPONENTS

CROSS REFERENCE TO RELATED APPLICATIONS

Illustrated in U.S. application Ser. No. 12/181,354 entitled Core Shell Intermediate Transfer Components, filed Jul. 29, 2008, the disclosure of which is totally incorporated herein by reference, is an intermediate transfer belt comprised of a substrate comprising a conductive core shell component.

BACKGROUND

Disclosed are intermediate transfer members, and more specifically, intermediate transfer members useful in transferring a developed image in an electrostatographic, for example xerographic, including digital, image on image, and the like, printers, machines or apparatuses. In embodiments, there are selected intermediate transfer members comprised of surface treated carbon black, which is subsequently dispersed in a polymer solution, such as a polyamic acid solution illustrated in copending applications U.S. application Ser. No. 12/129,995, U.S. Publication No. 20090297232, and U.S. application Ser. No. 12/181,354, U.S. Publication No. 20100028700, the disclosures of which are totally incorporated herein by reference. The carbon black can be treated with, for example, a poly(vinyltrialkoxysilane), and more specifically, a poly(vinyltriethoxysilane) (VTES), formed by the free radical polymerization of a vinyltrialkoxysilane, vinyltriethoxysilane, and the like.

A number of advantages are associated with the intermediate transfer member and belt (ITB) of the present disclosure, such as excellent primary size and aggregate size for the surface treated carbon black; dimensional stability; acceptable conductivities; a variety of formulation latitudes for the disclosed ITB as compared to an ITB with an untreated carbon black; ITB humidity insensitivity for extended time periods; excellent dispersability in a polymeric solution; low and acceptable surface friction characteristics; and a simplified economic ITB formation.

In a typical electrostatographic reproducing apparatus, a light image of an original to be copied is recorded in the form of an electrostatic latent image upon a photosensitive member, and the latent image is subsequently rendered visible by the application of electroscopic thermoplastic resin particles and colorant, which are commonly referred to as toner. Generally, the electrostatic latent image is developed by bringing a developer mixture into contact therewith. The developer mixture can comprise a dry developer mixture, which usually comprises carrier granules having toner particles adhering triboelectrically thereto, or a liquid developer material, which may include a liquid carrier having toner particles, dispersed therein. The developer material is advanced into contact with the electrostatic latent image and the toner particles are deposited thereon in image configuration. Subsequently, the developed image is transferred to a copy sheet. It can be advantageous in some situations to transfer the developed image to a coated intermediate transfer web, belt or component, and subsequently transfer with high transfer efficiency the developed image from the intermediate transfer member to a permanent substrate, followed by fixing.

In electrostatographic printing machines wherein the toner image is electrostatically transferred by a potential difference between the imaging member and the intermediate transfer member, the transfer of the toner particles to the intermediate transfer member and the retention thereof should be substantially complete so that the image ultimately transferred to the image receiving substrate will have a high resolution. Substantially about 100 percent toner transfer occurs when most or all of the toner particles comprising the image are transferred and little residual toner remains on the surface from which the image was transferred.

Intermediate transfer members permit a number of advantages such as enabling high throughput at modest process speeds, excellent registration of the final color toner image in color systems using synchronous development of one or more component colors using one or more transfer stations, and increasing the range of final substrates that can be used. However, a disadvantage of using an intermediate transfer member is that a plurality of transfer steps occurs allowing for the possibility of charge exchange occurring between toner particles and the transfer member which ultimately can lead to less than complete toner transfer. The result is low resolution images on the image receiving substrate and image deterioration. When the image is in color, the image can additionally suffer from color shifting and color deterioration.

In embodiments, the resistivity of the intermediate transfer member is within a range to allow for sufficient transfer. It is also desired that the intermediate transfer member has a controlled resistivity, wherein the resistivity is substantially unaffected by changes in humidity, temperature, bias field, and operating time. In addition, a controlled resistivity is of value so that a bias field can be established for electrostatic transfer. Also, it is of value that the intermediate transfer member not be too conductive as air breakdown can possibly occur.

Attempts at controlling the resistivity of intermediate transfer members have been accomplished by, for example, adding conductive fillers, such as ionic additives and/or carbon black, to the outer layer. For example, U.S. Pat. No. 6,397,034 discloses the use of a fluorinated carbon filler in a polyimide intermediate transfer member layer. However, there are disadvantages associated with the use of such additives, such as the undissolved particles frequently bloom or migrate to the surface of the polyimide polymer and cause known imperfections in this polymer. This leads to nonuniform resistivity, which can cause poor antistatic properties and poor mechanical strength. More specifically, the ionic additives on the ITB surface may interfere with toner release; bubbles may appear in the conductive polymer, some of which can only be seen with the aid of a microscope, and others of which are large enough to be observed with the naked eye. These bubbles result in poor or nonuniform electrical properties and poor mechanical properties.

In addition, the ionic additives themselves are sensitive to changes in temperature, humidity, and operating time. These sensitivities often limit the ITB resistivity range. For example, the ITB resistivity usually decreases by up to two orders of magnitude or more as the humidity increases from about 20 percent to 80 percent relative humidity. This effect limits the operational or process latitude.

Moreover, ion transfer can also occur in these systems. The transfer of ions leads to charge exchanges and insufficient transfers, which in turn causes low image resolution and image deterioration, thereby adversely affecting the copy quality. In color systems, additional adverse results include color shifting and color deterioration. Ion transfer also increases the resistivity of the polymer member after repetitive use. This can limit the process and operational latitude, and eventually the ion-filled polymer member will be unusable.

Therefore, it is desired to provide a weldable intermediate transfer belt which has excellent transfer capability. It is also desired to provide a weldable intermediate transfer belt that may not have puzzle cut seams, but instead, has a weldable seam, thereby providing a belt or member other than a belt that can be manufactured without such labor intensive steps as manually piecing together the puzzle cut seam with ones fingers, and without the lengthy high temperature and high humidity conditioning steps.

REFERENCES

Illustrated in U.S. Pat. No. 7,130,569, the disclosure of which is totally incorporated herein by reference, is a weldable intermediate transfer belt comprising a substrate comprising a homogeneous composition comprising a polyaniline in an amount of, for example, from about 2 to about 25 percent by weight of total solids, and a thermoplastic polyimide present in an amount of, for example, from about 75 to about 98 percent by weight of total solids, wherein the polyaniline has a particle size of, for example, from about 0.5 to about 5 microns.

In U.S. Pat. No. 7,031,647, the disclosure of which is totally incorporated herein by reference, there is illustrated an intermediate transfer belt, comprising a belt substrate comprising primarily at least one polyimide polymer; and a welded seam.

Also referenced is U.S. Pat. No. 7,280,791, the disclosure of which is totally incorporated herein by reference, which illustrates a weldable intermediate transfer belt comprising a substrate comprising a homogeneous composition comprising polyaniline in an amount of from about 2 to about 25 percent by weight of total solids, and thermoplastic polyimide in an amount of from about 75 to about 98 percent by weight of total solids, wherein the polyaniline has a particle size of from about 0.5 to about 5 microns.

Also referenced is U.S. Pat. No. 7,139,519, the disclosure of which is totally incorporated herein by reference, which illustrates an image forming apparatus for forming images on a recording medium comprising:

a charge-retentive surface to receive an electrostatic latent image thereon;

a development component to apply toner to the charge-retentive surface to develop the electrostatic latent image to form a developed toner image on the charge retentive surface;

an intermediate transfer member to transfer the developed toner image from the charge retentive surface to a copy substrate, wherein the intermediate transfer member comprises a substrate comprising a first binder and lignin sulfonic acid doped polyaniline dispersion; and a fixing component to fuse the developed toner image to the copy substrate.

The use of a polyaniline filler in a polyimide has been disclosed in U.S. Pat. No. 6,602,156. This patent discloses, for example, a polyaniline filled polyimide puzzle cut seamed belt. The manufacture of a puzzle cut seamed belt is labor intensive and costly, and the puzzle cut seam, in embodiments, is sometimes weak.

SUMMARY

Included within the scope of the present disclosure is an intermediate transfer belt, and transfer members other than a belt comprised of a substrate comprising a poly(vinylalkoxysilane) surface treated carbon black; an intermediate transfer media comprised of carbon black having chemically attached thereto a poly(vinylalkoxysilane); an apparatus for forming images on a recording medium comprising a charge retentive surface to receive an electrostatic latent image thereon;

a development component to apply toner to the charge retentive surface to develop the electrostatic latent image, and to form a developed image on the charge retentive surface; and an intermediate transfer belt to transfer the developed image from the charge retentive surface to a substrate, wherein the intermediate transfer belt is comprised of a substrate comprising a poly(vinylalkoxysilane) surface treated carbon black.

In addition, the present disclosure provides, in embodiments, an apparatus for forming images on a recording medium comprising a charge retentive surface to receive an electrostatic latent image thereon; a development component to apply toner to the charge retentive surface to develop the electrostatic latent image and to form a developed image on the charge retentive surface; a weldable intermediate transfer component, media, or belt for transferring the developed image from the charge retentive surface to a substrate, and a fixing component.

EMBODIMENTS

In embodiments, the carbon black surface is composed of graphitic planes with oxygen and hydrogen at the edges as, for example, represented by

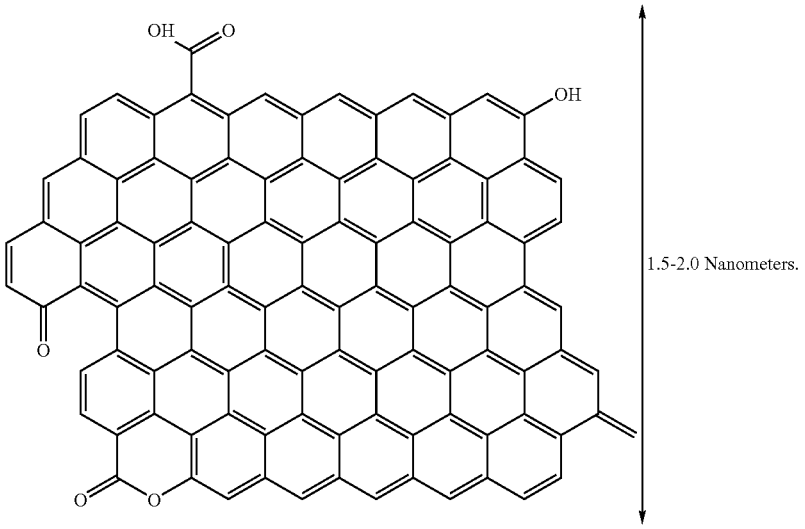

Carbon black surface groups can be formed by oxidation with an acid or with ozone, and where there is absorbed or chemisorbed oxygen groups from, for example, carboxylates, phenols, and the like. The carbon surface is essentially inert to most organic reaction chemistry except primarily for oxidative processes and free radical reactions.

Disclosed herein in embodiments is the chemical attachment of a poly(vinylalkoxysilane) onto carbon, such as carbon black, surfaces via free radical polymerization reactions. Specifically, carbon black is mixed with a vinylalkoxysilane or mixtures of vinylalkoxysilanes in a solvent. In the presence of a catalyst, a polymerization initiator and heat, the vinylalkoxysilane or mixtures thereof are polymerized by free radical polymerization to form a poly(vinylalkoxysilane) or its copolymers. While the polymerization is in progress, a number of the polymer chains are terminated onto the carbon black surfaces by the absorbed or chemisorbed oxygen groups from carboxylates, phenols, and the like on the carbon black surfaces. Thus, poly(vinylalkoxysilane) or its copolymers are chemically attached onto the carbon black surfaces. With proper filtration, washing and drying, the poly(vinylalkoxysilane) or its copolymers treated carbon blacks are obtained.

The conductivity of carbon black is dependent on at least three properties including surface area and its structure. Generally, the higher the surface area, the more conductive the carbon black. Surface area is measured by the B.E.T. nitrogen surface area per unit weight of carbon black, and is the measurement of the primary particle size. Structure is a complex property that refers to the morphology of the primary aggregates of carbon black. It is a measure of both the number of primary particles comprising a primary aggregate, and the manner in which they are "fused" together. High structure carbon blacks are characterized by aggregates comprised of many primary particles with considerable "branching" and "chaining", while low structure carbon blacks are characterized by compact aggregates comprised of fewer primary particles. Structure is measured by dibutyl phthalate (DBP) absorption by the voids within carbon blacks. The higher the structure, the more the voids, and the higher the DBP absorption.

Examples of carbon blacks that may be treated in accordance with embodiments of the present disclosure include VULCAN® carbon blacks, REGAL® carbon blacks, BLACK PEARLS® carbon blacks available from Cabot Corporation. Specific examples of conductive carbon blacks are BLACK PEARLS® 1000 (B.E.T. surface area=343 $m^2/g$, DBP absorption=105 ml/g), BLACK PEARLS® 880 (B.E.T. surface area=240 $m^2/g$, DBP absorption=106 ml/g), BLACK PEARLS® 800 (B.E.T. surface area=230 $m^2/g$, DBP absorption=68 ml/g), BLACK PEARLS® L (B.E.T. surface area=138 $m^2/g$, DBP absorption=61 ml/g), BLACK PEARLS® 570 (B.E.T. surface area=110 $m^2/g$, DBP absorption=114 ml/g), BLACK PEARLS® 170 (B.E.T. surface area=35 $m^2/g$, DBP absorption=122 ml/g), VULCAN® XC72 (B.E.T. surface area=254 $m^2/g$, DBP absorption=176 ml/g), VULCAN® XC72R (fluffy form of VULCAN® XC72), VULCAN® XC605, VULCAN® XC305, REGAL® 660 (B.E.T. surface area=112 $m^2/g$, DBP absorption=59 ml/g), REGAL® 400 (B.E.T. surface area=96 $m^2/g$, DBP absorption=69 ml/g), and REGAL® 330 (B.E.T. surface area=94 $m^2/g$, DBP absorption=71 ml/g).

Examples of vinylalkoxysilane selected for attachment to and treatment of the carbon black are represented by $$(CH_2{=}CH)Si(OR)_xR'_{3-x}$$

wherein x represents the number of OR groups, and the number of R' groups, and is, for example 1, 2 and 3; R is an alkyl including substituted alkyl group containing, for example, from 1 to about 10, and more specifically, from 1 to about 4 carbon atoms, and when x is 2 or 3, R can be the same or dissimilar; R' is an alkyl or substituted alkyl group containing, for example, from 1 to about 25, and more specifically, from 1 to about 6 carbon atoms, and when x is 1, R' can be the same or dissimilar.

Specific vinylalkoxysilane examples in accordance with embodiments of the present disclosure include vinyltriethoxysilane (VTES), diethoxy(methyl)vinylsilane, ethoxy(dimethyl)vinylsilane, triacetoxy(vinyl)silane, tris(2-methoxyethoxy)vinylsilane, the like, and the vinyltrimethoxysilanes can be represented by

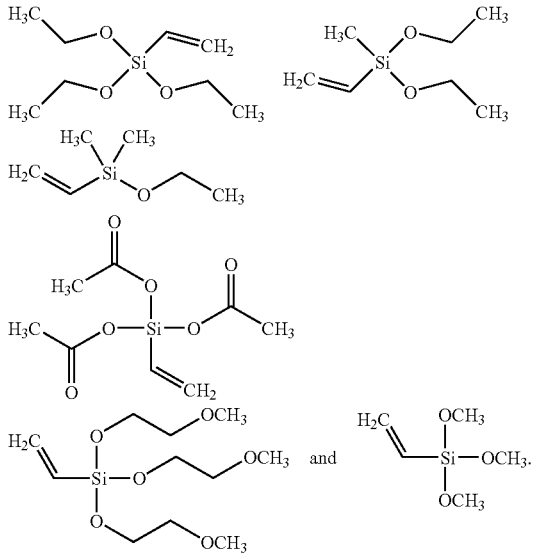

The weight ratio of carbon black and vinylalkoxysilane is, for example, from about 1/100 to about 100/1, from about 1/60 to about 20/1, from about 1/20 to about 5/1, or from about 1/5 to about 2/1. The molecular weight of the attached poly(vinylalkoxysilane) depends on both the vinylalkoxysilane amount and the initiator amount. In general, the higher the vinylalkoxysilane/initiator ratio, the higher the molecular weight of the poly(vinylalkoxysilane). The number average molecular weight of the attached poly(vinylalkoxysilane), for example, is from about 500 to about 500,000, from 2,000 to about 100,000, or from about 5,000 to about 20,000.

Examples of the catalyst or initiator selected for the polymerization are thermal initiators commonly used in free radical polymerizations. The polymerization temperatures can vary from about room temperature (25° C.) to higher temperatures, such as 200° C., depending on the initiator used to initiate the polymerization. At higher temperatures, the initiator molecule decomposes into free radicals, and causes the initiation of polymerization of the vinylalkoxysilane. Specific initiator examples include 2,2'-azobis(2-methylpropionitrile) (AIBN), 1,1'-azobis(cyclohexanecarbonitrile), benzoyl peroxide (BPO), dicumyl peroxide, di-tert-amyl peroxide, cumene hydroperoxide, 2,5-bis(tert-butylperoxy)-2,5-dimethylhexane, tert-butyl peroxybenzoate, tert-butylperoxy 2-ethylhexyl carbonate, and 1,1-bis(tert-butylperoxy)-3,3,5-trimethylcyclohexane, represented by

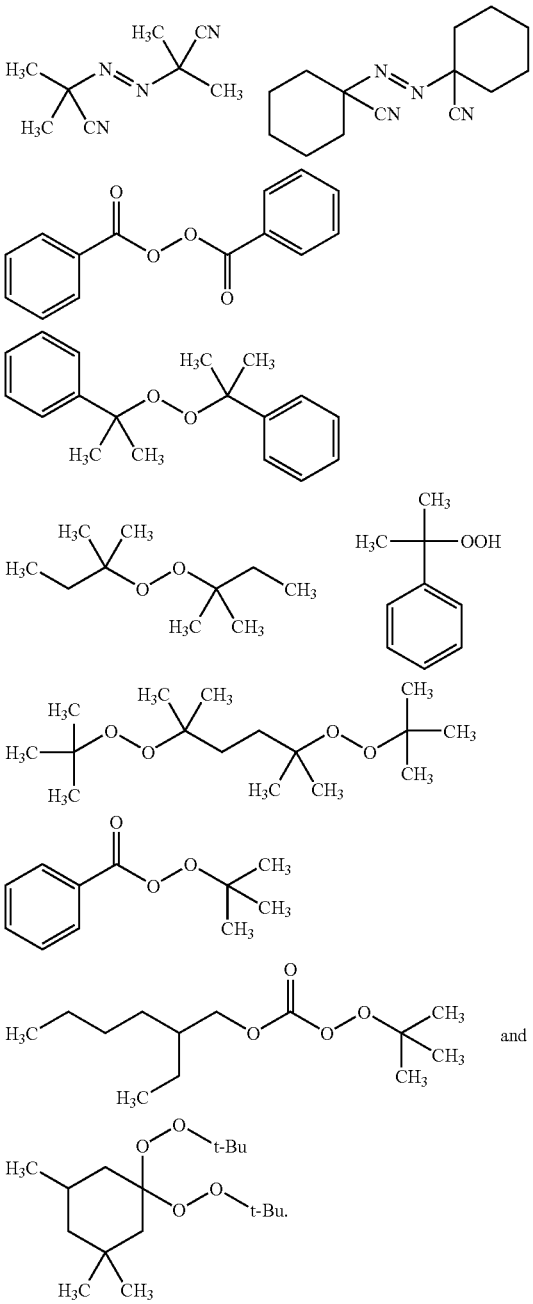

and

Examples of the solvent used as the polymerization media include, for example, N-methyl-2-pyrrolidone (NMP), N,N-dimethylacetamide (DMAC), N,N-dimethylformamide (DMF), tetrahydrofuran (THF), and other suitable known solvents.

Disclosed herein in embodiments is the chemical attachment of a poly(vinyltriethoxysilane) onto carbon, such as carbon black, surfaces by a free radical polymerization reaction, such as, for example, by the heating of a benzoyl peroxide to form a free radical, followed by the reaction of the free radical with a vinyltriethoxysilane (VTES) eventually resulting in the VTES being polymerized and attaching to the carbon black surface as more specifically illustrated herein.

The treated carbon black is usually formed into a dispersion with a number of materials, such as a polyamic acid solution, formed from a polyimide precursor. With a proper milling, a uniform dispersion is obtainable, and then coated on a glass plate using a draw bar coating method. The resulting film can be dried at high temperatures such as from about 100° C. to about 400° C. for about 20 to about 180 minutes while remaining on the glass plate. After drying and cooling to room temperature, the film on the glass can be immersed into water overnight, about 18 to 23 hours, and subsequently, the about 50 to about 150 microns thick film can be released from the glass to result in a functional intermediate transfer member.

Examples of a suitable polyamic acid solution selected include polyimide polymers such as VTEC™ PI 1388, 080-051, 851, 302, 203, 201 and PETI-5, all available from Richard Blaine International, Incorporated, Reading, Pa. The thermosetting polyimides, which can be cured at low temperatures, and more specifically, from about 180° C. to about 260° C. over a short period of time, such as from about 10 to about 120, and from about 20 to about 60 minutes, possess a number average molecular weight of from about 5,000 to about 500,000, or from about 10,000 to about 100,000, and a weight average molecular weight of from about 50,000 to about 5,000,000, or from about 100,000 to about 1,000,000. Other thermosetting polyimide precursors that may be selected and that are cured at higher temperatures (above 300° C.) than the VTEC™ PI polyimide precursors include PYRE-M.L® RC-5019, RC-5057, RC-5069, RC-5097, RC-5053 and RK-692, all commercially available from Industrial Summit Technology Corporation, Parlin, N.J.; RP-46 and RP-50, both commercially available from Unitech LLC, Hampton, Va.; DURIMIDE® 100 commercially available from FUJIFILM Electronic Materials U.S.A., Inc., North Kingstown, R.I.; KAPTON® HN, VN and FN, all commercially available from E.I. DuPont, Wilmington, Del.

The conductive treated carbon black component of the present disclosure can also be incorporated into thermoplastic materials such as a polyimide, a polycarbonate, a polyvinylidene fluoride (PVDF), a poly(butylene terephthalate) (PBT), a poly(ethylene-co-tetrafluoroethylene) copolymer, or mixtures thereof. Thermoplastic polyimide examples include KAPTON® KJ commercially available from E.I. DuPont, Wilmington, Del., as represented by

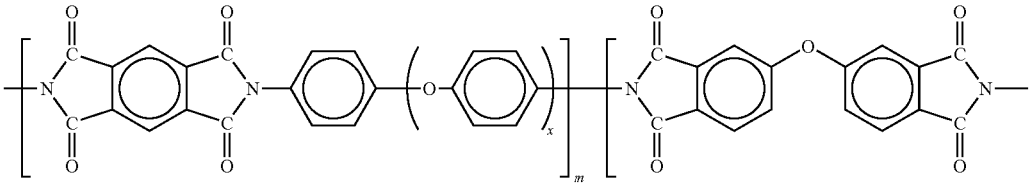

-continued

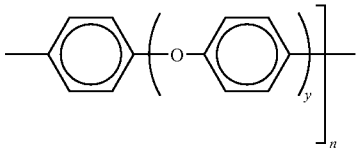

wherein x is 2, y is 2; m and n are from about 10 to about 300; and IMIDEX®, commercially available from West Lake Plastic Company, represented by

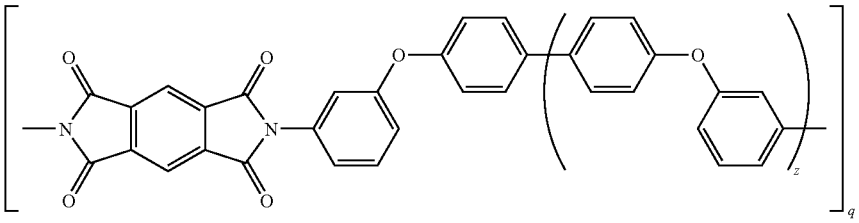

wherein z is 1, and q is from about 10 to about 300.

Also, in embodiments, examples of further components selected for the intermediate transfer member include additional conductive components and polymers, such as polyanilines. In embodiments, the polyaniline component has a relatively small particle size of from about 0.5 to about 5, from about 1.1 to about 2.3, from about 1.2 to about 2, from about 1.5 to about 1.9, or about 1.7 microns.

Specific examples of polyanilines are PANIPOL® F, commercially available from Panipol Oy, Finland; and lignosulfonic acid grafted polyaniline, represented by

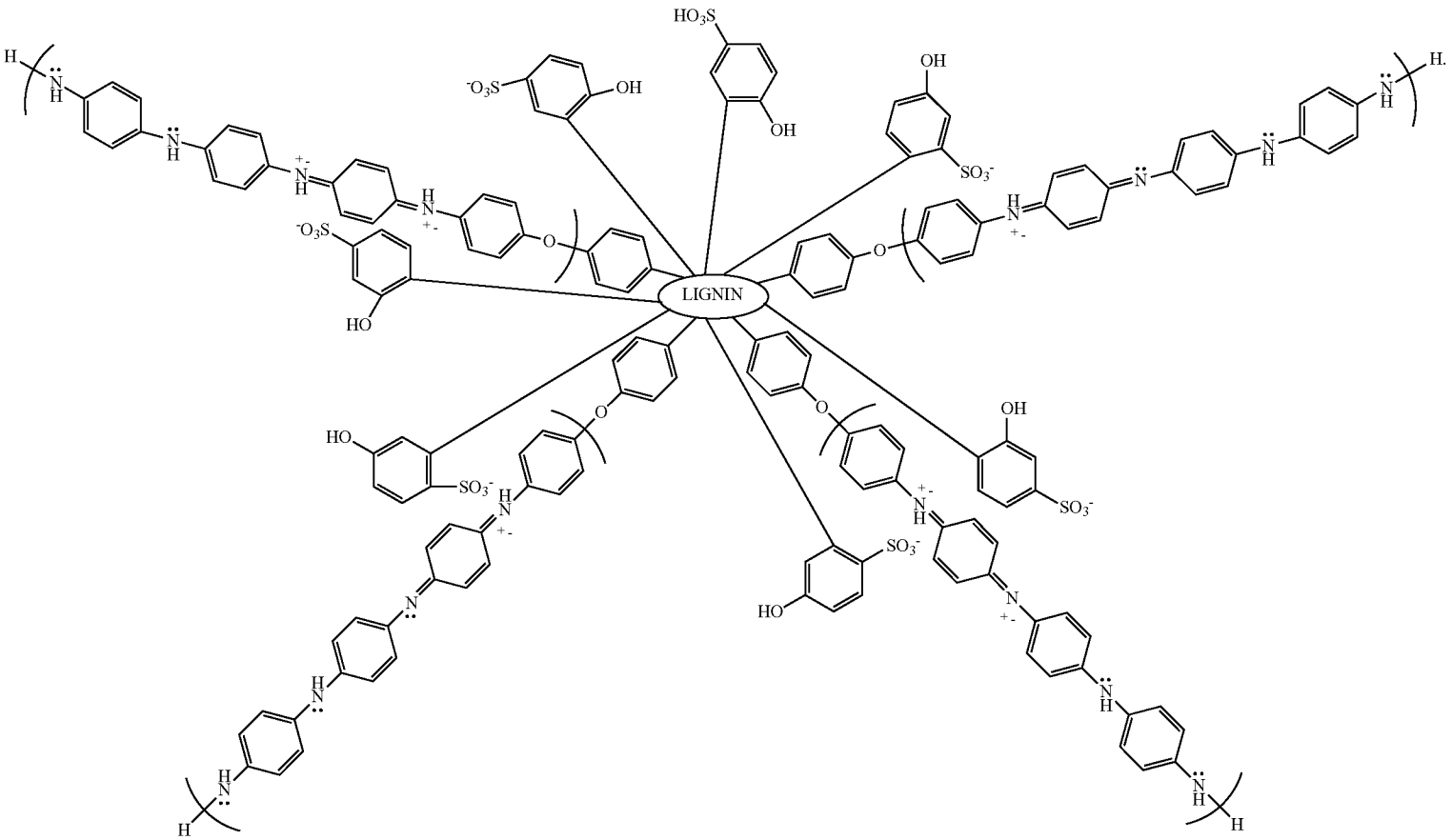
LIGNIN

The intermediate transfer members are, in embodiments, weldable, that is the seam of the polyimide belt is weldable, and more specifically, may be ultrasonically welded to produce a seam that is as strong as, or stronger than the polyimide material itself. In addition, the disclosed weldable members, such as belts, permit the avoidance of the use of carbon blacks and other fillers, although in embodiments carbon black or other fillers can be added.

In a multi-imaging system, each image being transferred is formed on the imaging drum by an image forming station, wherein each of these images is then developed at the developing station and transferred to the intermediate transfer member. The images may be formed on a photoconductor and developed sequentially, and then transferred to the intermediate transfer member. In an alternative method, each image may be formed on a photoconductor or photoreceptor drum, developed, and transferred in registration to the intermediate transfer member. In an embodiment, the multi-image system is a color copying system, wherein each color of an image being copied is formed on the photoreceptor drum, developed, and transferred to the intermediate transfer member.

After the toner latent image has been transferred from the photoconductor to the intermediate transfer member, the intermediate transfer member may be contacted under heat and pressure to an image receiving substrate such as paper. The toner image on the intermediate transfer member is then transferred and fixed, in image configuration, to a substrate such as paper.

The surface resistivity of the intermediate transfer member is, for example, from about $10^9$ to about $10^{13}$ or from about $10^{10}$ to about $10^{12}$ ohm/sq. The sheet resistivity of the intermediate transfer weldable member is from about $10^9$ to about $10^{13}$ or from about $10^{10}$ to about $10^{12}$ ohm/sq.

The intermediate transfer member can be of any suitable configuration. Examples of suitable configurations include a sheet, a film, a web, a foil, a strip, a coil, a cylinder, a drum, an endless strip, a circular disc, a belt including an endless belt, and an endless seamed flexible belt. The circumference of the belt configuration for 1 to 2 or more layers is from about 250 to about 2,500, from about 1,500 to about 2,500, or from about 2,000 to about 2,200 millimeters. The width of the film or belt is, for example, from about 100 to about 1,000, from about 200 to about 500, or from about 300 to about 400 millimeters.

Roughness of the ITB or member can be characterized by microgloss, wherein a rougher surface has a lower microgloss than a smoother surface. The microgloss values of the weldable intermediate transfer belt can be, for example, from about 85 to about 110, from about 90 to about 105, or from about 93 to about 98 gloss units at an 85° angle. The present disclosed belt, in embodiments, achieved the desired high gloss level without the need for additional fillers. Microgloss is a measure of the amount of light reflected from the surface at a specific angle, and can be measured with commercial equipment such as the Micro-TR1-gloss instrument from BYK Gardner.

Specific embodiments will now be described in detail. These examples are intended to be illustrative, and the disclosure is not limited to the materials, conditions, or process parameters set forth in these embodiments. All parts are percentages by weight of total solids unless otherwise indicated.

Example I

Surface Treatment of Carbon Black with Poly(Vinyltriethoxysilane)

Ten grams of VULCAN® XC72R carbon black, obtained from Cabot Corporation, with a BET of about 254 $m^2/g$ and a DBP absorption of 176 ml/g, 20 grams of vinyltriethoxysilane (VTES), obtained from Aldrich Chemicals, and 0.5 gram of the initiator, benzoyl peroxide (BPO), were mixed in 500 milliliters of NMP. The free radical polymerization of the VTES, and termination of the polymerization on the carbon black surface was accomplished by heating at 80° C. for 8 hours. The resulting mixture was then filtered, and the solid obtained was washed with 500 milliliters of tetrahydrofuran (THF) twice. The resulting surface treated carbon black with poly(vinylethoxysilane) chemically attached to the carbon black surface was dried at 50° C. under a vacuum overnight, about 23 hours, and the resulting surface treated carbon black was then used to prepare an ITB.

The XPS measurement of the treated carbon black showed 94.57 atom percent of carbon, 4.18 atom percent of oxygen, 1.11 atom percent of silicon, and 0.15 atom percent of sulfur. In contrast, the XPS measurement of the nontreated carbon black showed 99.48 atom percent of carbon, 0.37 atom percent of oxygen, and 0.15 atom percent of sulfur. For the treated carbon black, both silicon and oxygen atoms were elevated due, it is believed, to the attachment of poly(vinyltriethoxysilane) on the surface.

Comparative Example 1

Preparation of ITB with a Nontreated Carbon Black

VULCAN® XC72R carbon black, obtained from Cabot Corporation, with a BET of about 254 $m^2/g$ and a DBP absorption (dibutyl phthalate absorption which determines the carbon black structure) of 176 ml/g, was mixed with the polyamic acid solution, VTEC™ PI 1388 (PI, 20 weight percent solids in NMP, obtained from Richard Blaine International, Incorporated) with varying weight ratios [CB/PI=5/95 in Comparative Example 1 (A); CB/PI=5.5/94.5 in Comparative Example 1 (B); CB/PI=6/94 in Comparative Example 1 (C); CB/PI=6.5/93.5 in Comparative Example 1 (D); and CB/PI=7/93 in Comparative Example 1 (E)]. By ball milling with 2 millimeter stainless shot at 160 rpm overnight, about 23 hours, uniform dispersions were obtained, and then coated on glass plates using a draw bar coating method. Subsequently, each film obtained was dried at 100° C. for 20 minutes, and then 204° C. for an additional 20 minutes while remaining on the glass plate. After drying and cooling about 23 hours to room temperature, the film on the glass was immersed into water overnight, and the 50 micron freestanding films were released from the glass automatically.

Example II

Preparation of ITB with the Poly(Vinyltriethoxysilane) Treated Carbon Black

The above poly(vinyltriethoxysilane) treated VULCAN® XC72R carbon black (PVTES-CB) of Example I was mixed with the polyamic acid solution, VTEC™ PI 1388 (PI, 20 weight percent solids in NMP obtained from Richard Blaine International, Incorporated) with varying weight ratios [PVTES-CB/PI=5/95 in Example II (A), PVTES-CB/PI=5.5/94.5 in Example II (B), PVTES-CB/PI=6/94 in Example II (C), PVTES-CB/PI=6.5/93.5 in Example II (D), and PVTES-CB/PI=7/93 in Example II (E)]. By ball milling with 2 millimeter stainless shot at 160 rpm overnight, about 23 hours, uniform dispersions were obtained, and then coated on glass plates using a draw bar coating method. Subsequently, each film obtained was dried at 100° C. for 20 minutes, and then at 204° C. for an additional 20 minutes while remaining on the glass plate. After drying and cooling to room temperature, the film on the glass was immersed into water overnight, and the 50 micron freestanding films were released from the glass automatically.

During the above 204° C. drying (imidization), it is believed that the silanes on the carbon black surface reacted with each other, and were believed to be connected together by covalent bonds (Si—O—Si). Thus, the dimensional stability of the ITB film or belt may be improved due to the in situ formed inorganic network within the organic polyimide network with less sensitivity to both humidity and heat.

Surface Resistivity Measurement

The ITB devices of Comparative Example 1 and Example II were measured for surface resistivity (under 1,000V, averaging four measurements at varying places, 72° F., 22 percent room humidity) using a High Resistivity Meter (Hiresta-Up MCP-HT450, available from Mitsubishi Chemical Corp.).

The treated carbon black devices of Example I and the nontreated carbon black devices of Comparative Example 1 had the following surface resistivities in ohm/sq.

Example I

Weight Percentages of Carbon Black in ( )

| | |
|---|---|
| Over | (5 weight percent) |
| $(3.25 \neq 1.62) \times 10^{13}$ | (5.5 weight percent) |
| $(1.90 \neq 1.16) \times 10^{10}$ | (6 weight percent) |
| $(9.82 \neq 0.23) \times 10^{8}$ | (6.5 weight percent) |
| Under | (7 weight percent) |

Comparative Example 1

| | |
|---|---|
| Over | (5 weight percent) |
| Over | (5.5 weight percent) |
| Over | (6 weight percent) |
| Under | (6.5 weight percent) |
| Under | (7 weight percent) |

"Over" represents a less conductive device; "Under" represents a highly conductive device.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An intermediate transfer belt comprised of a substrate comprising a poly(vinylalkoxysilane) surface treated carbon black, wherein said poly(vinylalkoxysilane) is a homopolymer or copolymer of vinylalkoxysilane, and wherein said vinylalkoxysilane is represented by $$(CH_2{=}CH)Si(OR)_xR'_{3-x}$$

wherein x is a number of 1, 2 or 3; R is alkyl with from 1 to about 10 carbon atoms; and R' is an alkyl with from 1 to about 25 carbon atoms.

2. An intermediate transfer belt in accordance with claim 1 wherein R alkyl contains from 1 to about 4 carbon atoms; and R' alkyl contains from 1 to about 6 carbon atoms.

3. An intermediate transfer belt in accordance with claim 1 wherein said vinylalkoxysilane is selected from the group consisting of vinyltriethoxysilane, diethoxy(methyl)vinylsilane, ethoxy(dimethyl)vinylsilane, triacetoxy(vinyl)silane, tris(2-methoxyethoxy) vinylsilane, vinyltrimethoxysilane, and mixtures thereof.

4. An intermediate transfer belt in accordance with claim 1 wherein said vinylalkoxysilane is represented by at least one of

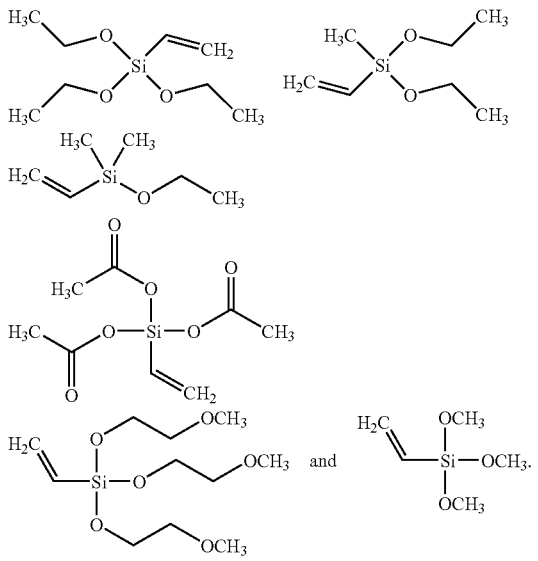

5. An intermediate transfer belt in accordance with claim 1 wherein said poly(vinylalkoxysilane) is poly(vinyltriethoxysilane).

6. An intermediate transfer belt in accordance with claim 5 wherein the weight ratio of carbon black/poly(vinyltriethoxysilane) is from about 1/5 to about 50/1.

7. An intermediate transfer belt in accordance with claim 1 wherein the weight ratio of said carbon black to said poly (vinylalkoxysilane) is from about 1/10 to about 100/1, and said poly(vinylalkoxysilane) surface treated carbon black is present in an amount of from about 1 to about 30 percent by weight based on the weight of total solids.

8. An intermediate transfer belt in accordance with claim 1 wherein the weight ratio of said carbon black to said poly (vinylalkoxysilane) is from about 1/4 to about 30/1, and said poly(vinylalkoxysilane) surface treated carbon black is present in an amount of from about 3 to about 15 percent by weight based on the weight of total solids.

9. An intermediate transfer belt in accordance with claim 1 further including a polyaniline present in an amount of from about 1 to about 30 percent by weight based on the weight of total solids.

10. An intermediate transfer belt in accordance with claim 9 wherein said polyaniline is present in an amount of from about 3 to about 15 percent by weight based on the weight of total solids.

11. An intermediate transfer belt in accordance with claim 1 wherein said belt has a surface resistivity of from about $10^9$ to about $10^{13}$ ohm/sq.

12. An intermediate transfer belt in accordance with claim 11 wherein said surface resistivity is from about $10^{10}$ to about $10^{12}$ ohm/sq.

13. An intermediate transfer belt in accordance with claim 1 further comprising an outer release layer positioned on said substrate.

14. An intermediate transfer belt in accordance with claim 13 wherein said release layer comprises poly(vinyl chloride).

15. An intermediate transfer belt in accordance with claim 1 wherein said intermediate transfer belt has a circumference of from about 250 to about 2,500 millimeters.

16. An intermediate transfer belt in accordance with claim 1 wherein said surface treated carbon black is dispersed in a polymer.

17. An intermediate transfer belt in accordance with claim 16 wherein said polymer is selected from the group consisting of a thermosetting polyimide, a thermoplastic polyimide, a polycarbonate, a polyvinylidene fluoride, a poly(butylene terephthalate), a poly(ethylene-co-tetrafluoroethylene) copolymer, and mixtures thereof.

18. An intermediate transfer belt in accordance with claim 1 wherein said substrate possess a B.E.T. surface area of from about 20 to about 1,000 $m^2/g$.

19. An intermediate transfer belt in accordance with claim 1 wherein said carbon black/surface treated carbon black possess a B.E.T. surface area of from about 100 to about 500 $m^2/g$.

20. An intermediate transfer belt in accordance with claim 1 wherein said carbon black possesses a DBP absorption of from about 10 to about 500 ml/g.

21. An intermediate transfer belt in accordance with claim 1 wherein said carbon black possesses a DBP absorption of from about 60 to about 300 ml/g.

22. An intermediate transfer belt in accordance with claim 1 wherein alkyl is a substituted alkyl.

23. An intermediate transfer member comprised of carbon black having chemically attached thereto a poly(vinylalkoxysilane), wherein said poly(vinylalkoxysilane) is a homopolymer or copolymer of vinylalkoxysilane, and wherein said homopolymer or copolymer is poly(vinyltriethoxysilane).

24. An intermediate transfer member in accordance with claim 23 wherein said poly(vinyltriethoxysilane) is generated by the free radical polymerization of vinyltriethoxysilane.

25. An intermediate transfer member in accordance with claim 24 wherein said polymerization is accomplished by heating at a temperature of from about 25° C. to about 160° C.

26. An intermediate transfer member in accordance with claim 24 wherein said polymerization is accomplished by heating at a temperature of from about 60° C. to about 140° C.

* * * * *